US007432820B1

(12) United States Patent
Phan et al.

(10) Patent No.: US 7,432,820 B1
(45) Date of Patent: Oct. 7, 2008

(54) SOUND-FLAG SYNCHRONIZED ACTION CONTROLLER

(76) Inventors: Charlie D. Phan, 1215 Garden Rd., Memphis, TN (US) 38134; Marc T. Phan, 1215 Garden Rd., Memphis, TN (US) 38134

( * ) Notice: Subject to any disclaimer, the term of this patent is extended or adjusted under 35 U.S.C. 154(b) by 0 days.

(21) Appl. No.: 11/809,334

(22) Filed: May 31, 2007

(51) Int. Cl.
*G08B 21/00* (2006.01)

(52) U.S. Cl. ..... 340/679; 340/815.4; 40/218; 116/173

(58) Field of Classification Search ..... 340/679, 340/815.4, 815.83; 40/218; 116/173
See application file for complete search history.

(56) References Cited

U.S. PATENT DOCUMENTS

| | | | | |
|---|---|---|---|---|
| 1,102,270 | A | 7/1914 | Howard | 40/218 |
| 1,660,341 | A | 2/1928 | Lapworth | 40/218 |
| 1,725,250 | A | 8/1929 | Burgess | 40/218 |
| 2,270,753 | A | 1/1942 | Fikes | 40/218 |
| 3,238,861 | A | 3/1966 | Fromme | 454/154 |
| 4,207,696 | A | 6/1980 | Hyman et al. | 40/473 |
| 5,092,808 | A | 3/1992 | Takasaka et al. | 446/178 |
| 5,209,695 | A | 5/1993 | Rothschild | 446/175 |
| 5,227,750 | A | 7/1993 | Connel et al. | 335/86 |
| 5,407,376 | A | 4/1995 | Avital | 446/175 |
| 5,427,050 | A * | 6/1995 | Horn | 116/173 |
| 5,460,203 | A | 10/1995 | Smith | 239/407 |
| 5,613,615 | A | 3/1997 | Zeyfang et al. | 220/203.11 |
| 5,826,535 | A | 10/1998 | Shaw | 116/173 |
| 5,977,656 | A | 11/1999 | John | 307/43 |
| 6,155,837 | A | 12/2000 | Konneliussen | 434/226 |
| 6,313,513 | B1 | 11/2001 | Imanishi | 257/401 |
| RE38,069 | E | 4/2003 | Posa | 315/194 |
| 6,603,221 | B1 | 8/2003 | Liu | 307/125 |
| 6,622,648 | B2 | 9/2003 | Shaw | 116/173 |
| 6,622,649 | B1 * | 9/2003 | Shaw | 116/173 |
| 6,634,123 | B1 | 10/2003 | Bradley et al. | 40/214 |
| 6,845,001 | B1 | 1/2005 | Kinbara | 361/152 |
| 6,990,921 | B2 * | 1/2006 | Milner et al. | 116/173 |
| 7,009,111 | B1 | 3/2006 | Rintz | 174/66 |
| 7,017,510 | B1 * | 3/2006 | Nair | 116/173 |
| 7,095,304 | B2 | 8/2006 | Yoshihiko et al. | 335/255 |
| D536,436 | S | 2/2007 | Nishizawa | D23/393 |
| 7,183,929 | B1 | 2/2007 | Antebi et al. | 340/573.1 |
| 7,196,913 | B2 | 3/2007 | Tsuruya et al. | 363/21.06 |
| 2002/0178997 | A1 * | 12/2002 | Tsui-Hua | 116/174 |

* cited by examiner

*Primary Examiner*—George A Bugg
*Assistant Examiner*—Samuel J Walk

(57) ABSTRACT

The invention provides means to control flag movement. Sound activated unit responds to sound impulse to activate electric current flows to a switch-electromagnet. Switch-electromagnet effects directly on "Sound-flag synchronized action controller electrical switch" to turn an activated electric circuit "ON". Activated electric current flows to "wind control bar electromagnets" to control velocity of blower wind current in flagpole interior to make flag actions such as waving, jumping and dancing.

3 Claims, 4 Drawing Sheets

SOUND-FLAG SYNCHRONIZED ACTION CONTROLLER

BACKGROUND OF THE INVENTION

1. Field of Invention

This invention relates to sound-flag synchronized action controller, particularly, to the use of sound, voice or dominant beat of music impulse to control blower wind velocity in flagpole interior to create beautiful view and higher potential movements of action-flag.

2. Description of Prior Art

Using blower to fly flag, using valve to control airflow, using switch to connect electrical poles and using sound to activate light chase are known in prior arts. Known prior art includes: U.S. Pat. No. 7,017,510; U.S. Pat. No. 6,990,921; U.S. Pat. No. 6,634,123; U.S. Pat. No. 6,622,649; U.S. Pat. No. 6,155,837; U.S. Pat. No. 5,826,535; U.S. Pat. No. 5,427,050; U.S. Pat. No. 2,710,753; U.S. Pat. No. 1,725,250; U.S. Pat. No. 1,660,341; U.S. Pat. No. 1,102,270

U.S. Pat. No. 7,095,304; U.S. Pat. No. 5,613,615; U.S. Pat. No. 5,092,808; U.S. Pat. No. 3,238,861; U.S. Pat. No. D536,436

U.S. Pat. No. 7,196,913; U.S. Pat. No. 7,009,111; U.S. Pat. No. 6,845,001; U.S. Pat. No. 6,603,221; U.S. Pat. No. 6,313,513; U.S. Pat. No. 5,977,656; U.S. Pat. No. 5,227,750; U.S. Pat. No. RE38,069

U.S. Pat. No. 7,183,929; U.S. Pat. No. 5,407,376; U.S. Pat. No. 5,209,695; U.S. Pat. No. 4,207,696

Each of these prior design arts fulfills its respective in objectives and requirements but did not disclose a new device: the sound-flag synchronized movement controller, new theory and new method of action-flag actions in the new invention.

To address these problems, the sound-flag synchronized action controller provides the means to control and activate the action-flag actions.

Thus, it is necessary to make a changing in theory and the operation way of flag in order to create beautiful view and higher potential movements of action-flag.

BRIEF SUMMARY OF THE INVENTION

The invention uses sound, voice or dominant beat of music as impulse to control higher potential of action-flag movement. More particularly, the invention relates to sound-flag synchronized action controller, an effective device to create action-flag actions such as waving, jumping and dancing.

Sound-flag synchronized action controller assembly consists: flagpole, flagpole interior, blower, action-flag, sound impulse, sound activated unit, "sound-flag synchronized action controller electrical switch", "sound-flag synchronized action flagpole wind current controller" and electric circuits.

"Sound-flag synchronized action flagpole wind current controller" consists a flagpole wind control plate, an axis, a flagpole wind control bar and three kinds of control electromagnet. Flagpole wind control plate is in flagpole interior and lies symmetrically on a rotation axis. The two ends of rotation axis hang on flagpole at flagpole diameter. Rotation axis connects at right angle with a flagpole wind control bar at one end to make the position of flagpole wind control bar and flagpole wind control plate looks like a letter T. Flagpole wind control bar position is vertical and flagpole wind control plate position is horizontal. Flagpole wind control bar movement makes rotation axis and flagpole wind control plate to move. Opening of flagpole wind control plate lets blower wind current to move into flagpole interior toward action-flag and wave the action-flag.

Right angle rotation of flagpole wind control bar is maneuvered by three kinds of control electromagnet, one flagpole wind control bar push-electromagnet, one flagpole wind control bar pull-electromagnet and one flagpole wind control bar hold-electromagnet. Flagpole wind control bar push-electromagnet pushes flagpole wind control bar to rotate upward. Flagpole wind control bar pull-electromagnet pulls flagpole wind control bar to horizontal position to rotate flagpole wind control plate vertically: an air way is opened. Flagpole wind control bar hold-electromagnet holds flagpole wind control bar as long as necessary. The flagpole wind controls bar hold-electromagnet and flagpole wind control bar pull-electromagnet are at horizontal position and flagpole wind control bar push-electromagnet is at vertical position.

A sound activated unit receives sound impulse and activates one "sound-flag synchronized action controller electrical switch electromagnet electric current" flows to switch-electromagnet to turn on a "sound-flag synchronized action controller electrical switch". "Sound-flag synchronized action controller electrical switch" connects another electric current to activate control electromagnets to be effected on flagpole wind control bar. Flagpole wind control bar rotates 90 degree to open flagpole wind control plate. Opening of flagpole wind control plate lets blower wind current going through flagpole interior to wave action-flag or to move things. When there is no sound impulse there is not any electric current flows, the control electromagnets do not active. The gravity of flagpole wind control bar pull it down, back to previous vertical position to close the flagpole wind control plate at horizontal position: no blower wind current to blow action-flag. Accordingly, the sound, the electrical switch, the flagpole wind current controller and the action-flag begin each cycle of sound-flag synchronized action.

The devices of present invention use the conduct of hundreds of different sound impulse to control velocity of blower wind current in flagpole interior to make hundreds of different motion of action-flag and create action-flag actions such as waving, jumping and dancing.

The "sound-flag synchronized action flagpole wind current controller" of new invention can be put directly in flagpole interior or indirectly in blower pipe interior connects to flagpole.

Optimally, this unit may be suitable for particular purposes of action-flag displaying at competition ceremony, award presentation, building, decorative place and may be suitable for entertainment and toy industry.

BRIEF DESCRIPTION OF THE DRAWINGS

In the drawings, like elements are depicted by like reference numerals. The drawings are briefly described as follows.

Figure 1:
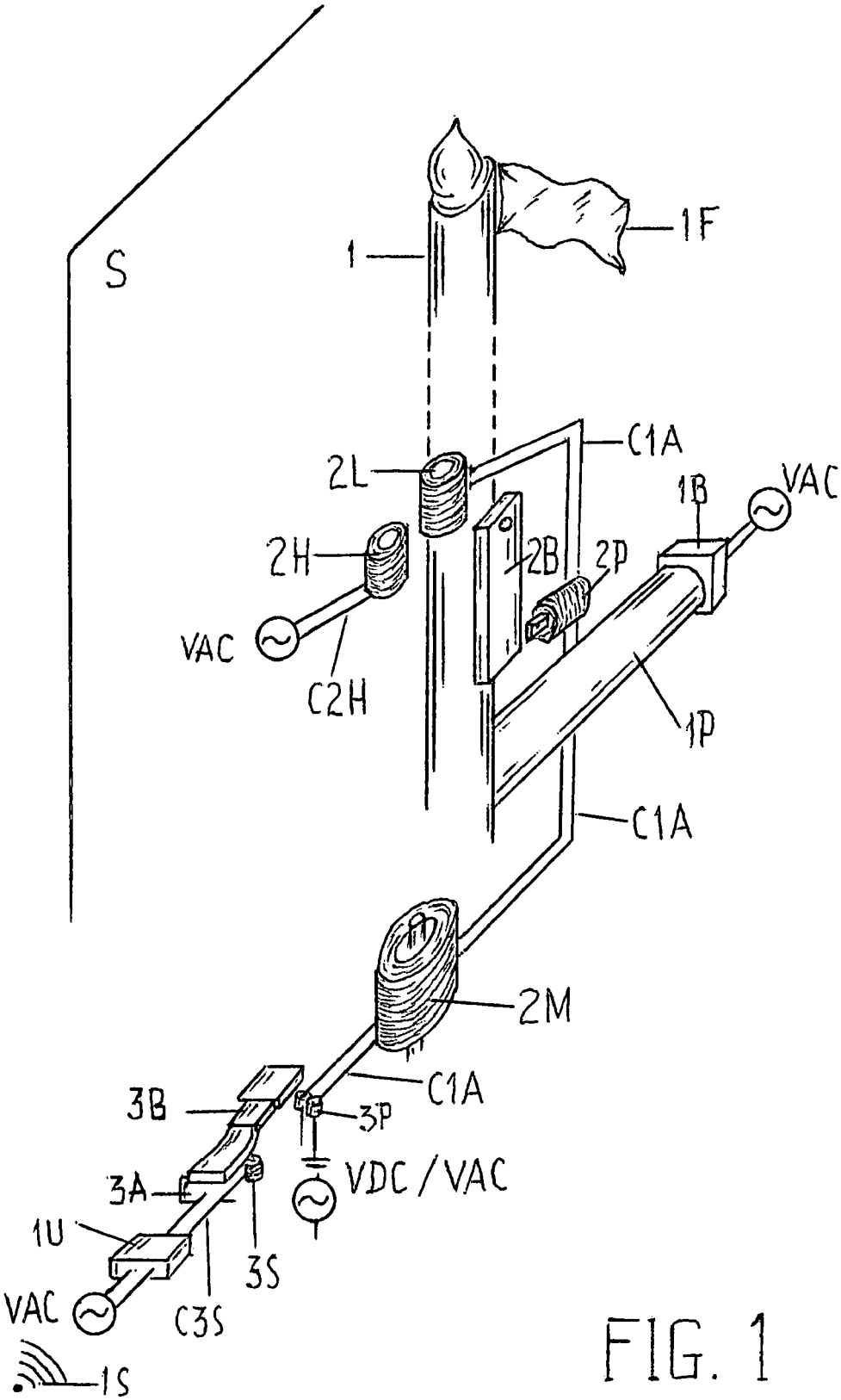
FIG. 1 is a diagrammatic perspective view of a sound-flag synchronized action controller assembly of the new invention, illustration: flagpole; action-flag; blower, blower pipe, blower electric circuit; sound impulse, sound activated unit, sound activated unit electric circuit; "sound-flag synchronized action controller electrical switch" assembly; activated electric circuit; motive devices; flagpole wind control bar, flagpole wind control bar push-electromagnet, flagpole wind control bar pull-electromagnet, flagpole wind control bar hold-electromagnet and hold-electromagnet electric circuit; and electric power sources.

| REFERENCE NUMERALS USED IN THE DESCRIPTION | |
|---|---|
| Flagpole | 1 |
| Flagpole interior | 1A |
| Blower | 1B |
| Blower pipe | 1P |
| Blower wind current | → |
| Action-flag | 1F |
| Sound impulse | 1S |
| Sound activated unit | 1U |
| Sound-flag synchronized action controller | SFC |
| Sound-flag synchronized action flagpole wind current controller 2 | |
| Rotation axis | 2A |
| Flagpole wind control bar | 2B |
| Flagpole wind control plate | 2C |
| Flagpole wind control bar push-electromagnet | 2P |
| Flagpole wind control bar pull-electromagnet | 2L |
| Flagpole wind control bar hold-electromagnet | 2H |
| Hold-electromagnet electric circuit | C2H |
| Activated electric circuit | C1A |
| Motive devices | 2M |
| Sound-flag synchronized action controller electrical switch in "OFF" position 3 | |
| Switch base | 3A |
| Switchblade | 3B |
| Flat spring | 3F |
| Non-electrical conductive handle | 3H |
| Conductive bridge | 3R |
| Electric circuit pole | 3P |
| Switch-electromagnet | 3S |
| Switch-electromagnet electric circuit | C3S |
| Sound-flag synchronized action controller electrical switch in "ON" position 4 | |
| Electric power sources | VDC, VAC |

DETAILED DESCRIPTION OF THE INVENTION

Figure 1A:
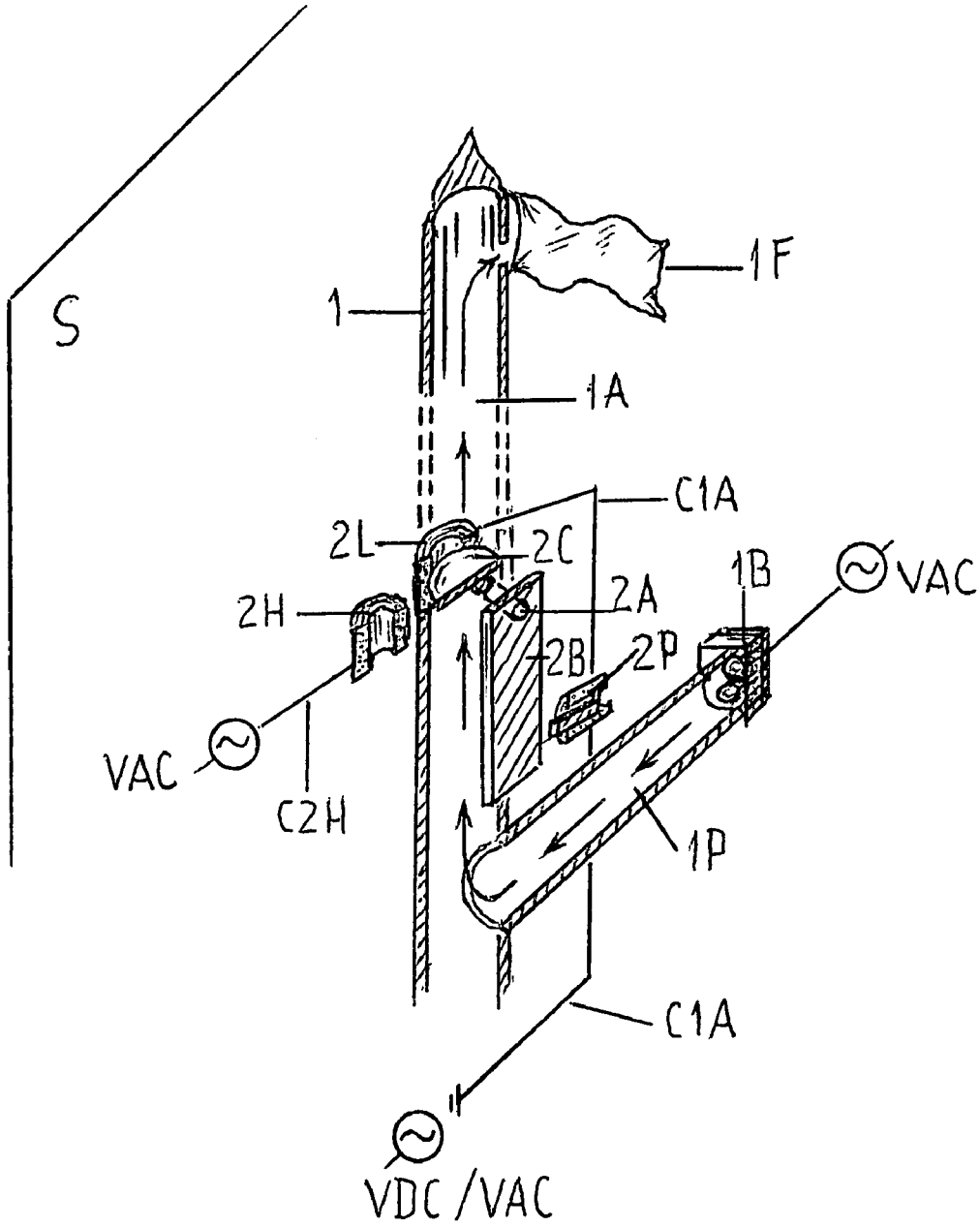
FIG. 1A is a cross-sectional view taken on vertical plane S of FIG. 1 illustration: blower, blower wind current, flagpole, flagpole interior, action-flag; flagpole wind control bar, flagpole wind control plate, rotation axis.
Figure 2:
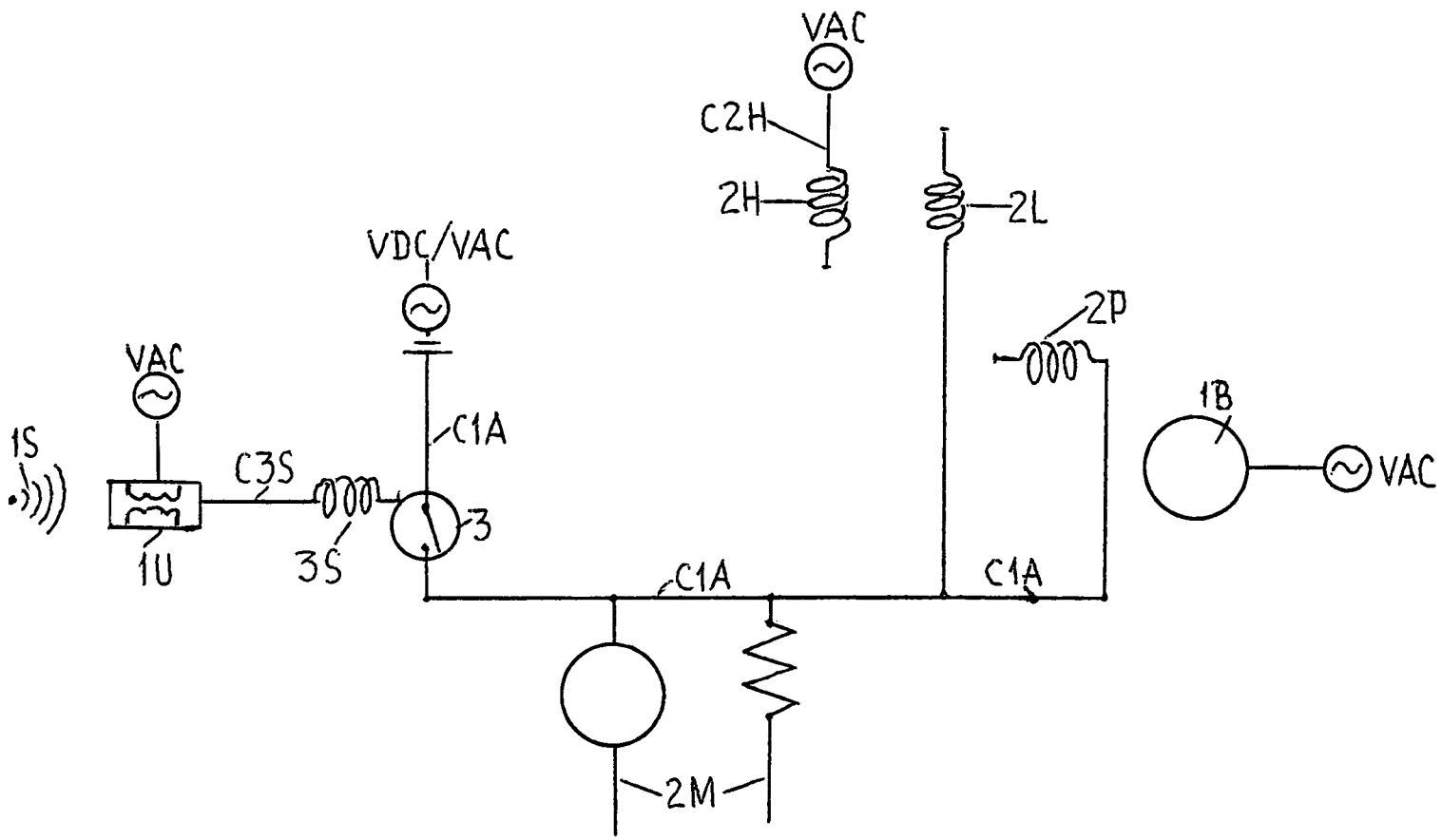
FIG. 2 is an electric circuit diagram of sound-flag synchronized action controller, illustration: switch-electromagnet electric circuit; activated electric circuit; hold-electromagnet electric circuit, sound activated unit electric circuit and blower electric circuit.

Sound-flag synchronized action controller assembly SFC as illustrated in FIG. 1 and FIG. 1A consists: flagpole 1, flagpole interior 1A, blower 1B, blower pipe 1P, blower wind current→, action-flag 1F, sound activated unit 1U, "sound-flag synchronized action flagpole wind current controller"2, "sound-flag synchronized action controller electrical switch"3, motive devices 2M, and electric circuits C1A, C2H and C3S. FIG. 2 is an electric circuit diagram of sound-flag synchronized action controller illustration: switch-electromagnet electric circuit C3S; activated electric circuit C1A; hold-electromagnet electric circuit C2H, sound activated unit electric circuit and blower electric circuit. "Sound-flag synchronized action flagpole wind current controller" 2 consists: a rotation axis 2A, a flagpole wind control bar 2B, flagpole wind control plate 2C, flagpole wind control bar push-electromagnet 2P, flagpole wind control bar pull-electromagnet 2L, flagpole wind control bar hold-electromagnet 2H and flagpole wind control bar hold-electromagnet electric circuit C2H. Flagpole wind control bar 2B is made of magnetic metal. "Sound-flag synchronized action controller electrical switch" 3 in "OFF" position FIG. 3 and in "ON" position FIG. 4 consists: switch base 3A, switchblade 3B, flat spring 3F, non-electrical conductive handle 3H and electrical conductive bridge 3R; electric switch poles 3P, switch-electromagnet 3S and switch-electromagnet electric circuit C3S.

In the prior art blower wind current→from blower 1B blows through blower pipe 1P to flagpole interior 1A and blows flag 1F. The normal appearance and operation of standard flagpole 1 is effective only when there is blower wind current→; otherwise the flag 1F does not fly and uncontrollable. To address these problems, the sound-flag synchronized action controller assembly SFC provides the means to control and activate flag movement. In the new invention the actions of action-flag such as waving, jumping and dancing depend on the velocity of blower wind current→in flagpole interior 1A, which is controlled by the opening and closing of flagpole wind control plate 2C under the conduct of sound impulse 1S. The synchronization between sound and movement of action-flag is more exciting and attractive when it is combined with other movement devices, dancing show, marching band etc. The sequence of sound-flag synchronized action is illustrated below:

FIG. 1 and FIG. 1A illustrate the sound-flag synchronized action controller assembly SFC. In prior art the sound activated unit 1U receives sound impulse 1S to activate an electric current flows to lights for chasing. In new invention the sound activated unit 1U receives sound impulse 1S to activate a "sound-flag synchronized action controller electrical switch electromagnet electric current" flows to switch-electromagnet electric circuit C3S, FIG. 2 to activate switch-electromagnet 3S. Switch-electromagnet 3S pulls or pushes down switchblade 3B to make the electrical conductive bridge 3R touches down sound flag synchronized action controller electrical switch poles 3P to connect an activated electric circuit C1A: the "sound-flag synchronized action controller electrical switch" is "ON" position FIG. 4. The electric current flows in activated electric circuit C1A, FIG. 2 effects on several motive devices 2M, including two electromagnets: flagpole wind control bar push-electromagnet 2P and flagpole wind control bar pull-electromagnet 2L. Flagpole wind control bar push-electromagnet 2P and flagpole wind control bar pull-electromagnet 2L are mounted at right angle positions with each other, flagpole wind control bar push-electromagnet 2P is at vertical position and flagpole wind control bar pull-electromagnet 2K is at horizontal position. When the electric current in activated electric circuit C1A flows to the two flagpole wind control bar electromagnets 2P and 2L, flagpole wind control bar push-electromagnet 2P pushes flagpole wind control bar 2B to rotate upward and flagpole wind control bar pull-electromagnet 2L pulls flagpole wind control bar 2B to horizontal position. At this moment flagpole wind control plate 2C rotates upward vertical position, the same parallel position with flagpole interior.

Flagpole wind control bar 2B rotates 90 degree angle will open flagpole wind control plate 2C completely. Opening of flagpole wind control plate 2C lets blower wind current→blows through flagpole interior 1A toward and flies action-flag 1F. At this point the electromagnets 2P and 2L do not active to push or pull flagpole wind control bar 2B. The flagpole wind control bar 2B falls down, back to previous vertical position to make the flagpole wind control plate 2C in horizontal closed position: no blower wind current→to wave action-flag 1F. Accordingly, the flagpole wind control plate 2C begins each cycle in sound-flag synchronized action. The sequence opening and closing of flagpole wind control plate 2C is controlled by hundreds of different sound impulse 1S to create hundreds of different motion of action-flag 1F: action-flag 1F actions such as waving, jumping and dancing.

The rotation of flagpole wind control bar 2B can be controlled directly by hand holding at flagpole wind control bar 2B, or indirectly by radio wave device, by sound, by voice, by musical pulse and by computer program through control devices.

Flagpole wind control bar hold-electromagnet 2H and its own electric circuit C2H can continuously holds flagpole wind control bar 2B at horizontal position to open flagpole wind control plate 2C and let blower wind current→flies action-flag 1F continuously.

Figure 3:
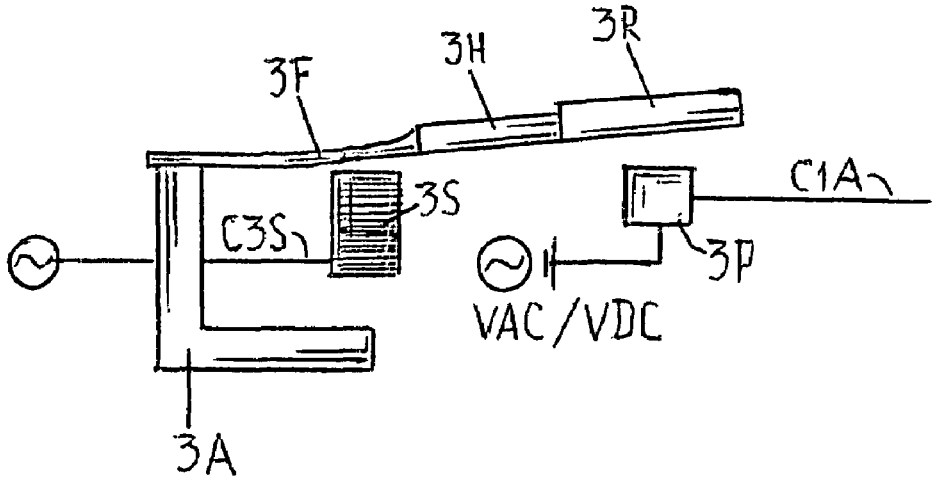
FIG. 3 is diagrammatic side view of a "sound-flag synchronized action controller electrical switch" in "OFF" position, illustration: sound activated unit electric circuit; switch base, switchblade, flat spring, non-electrical conductive handle, conductive bridge, electrical switch poles, switch-electromagnet and switch-electromagnet circuit.
Figure 4:
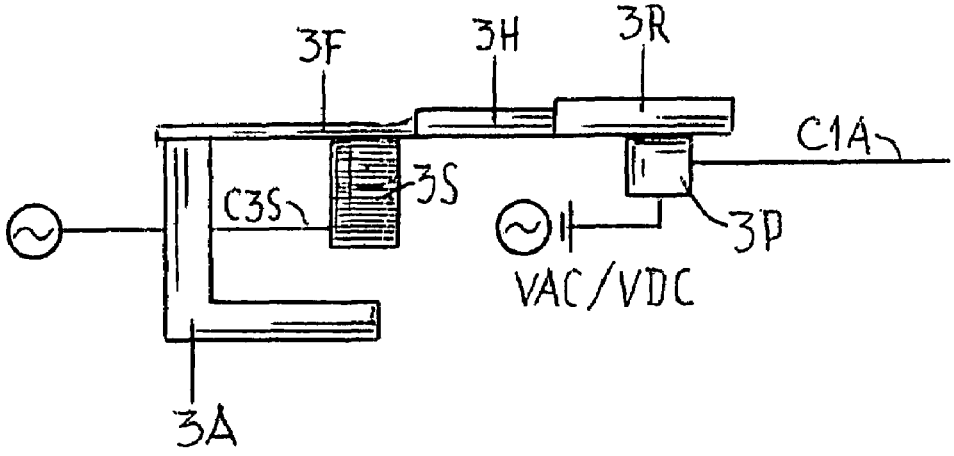
FIG. 4 is diagrammatic side view of a "sound-flag synchronized action controller electrical switch" in "ON" position.

FIG. 3 and FIG. 4 illustrate a "sound-flag synchronized action controller electrical switch" 3. The "sound-flag synchronized action controller electrical switch"3 consists: switch base 3A, switchblade 3B, switch-electromagnet 3S and switch poles 3P. Switchblade 3B includes three parts attach together: switch flat spring 3F, non-electrical conductive handle 3B and electrical conductive bridge 3R. One end of switch flat spring 3F is mounted on switch base 3A, another end attaches with one end of non-electrical conductive handle 3B. Switch flat spring 3F is made of magnetic metal and is separated with electrical conductive bridge 3R by a non-electrical conductive handle 3B in the middle. Switch-electromagnet 3S could be either flagpole wind control bar pull-electromagnet when it locates below switchblade 2B or flagpole wind control bar push-electromagnet when it locates above switchblade 2B.

As we have known there were many kinds of electric switch in the prior arts used to connect the electric current going through switchblade 3B. In the new invention the "sound-flag synchronized action controller electrical switch" 3 lets the electric current going through only one part of switchblade 3B at switch electrical conductive bridge 3R to connect other electric current of activated electric circuit C1A to effect on motive devices 2M. Activated electric circuit C1A is independent from switch-electromagnet electric circuit C3S; therefore activated electric circuit C1A can load a heavy-duty electric power to use for several electrical motive devices 2M such as motor, solenoid, air valve controller etc. in the movement not only of action-flag, but also of action-puppet, model and thing. When sound activated unit 1U responds to sound impulse 1S, one "sound-flag synchronized action controller electrical switch electromagnet electric current" will be create to flow in switch-electromagnet electric circuit C3S to activate switch-electromagnet 3S. Switch-electromagnet 3S pulls or pushes switchblade 2B down to make conductive bridge 3R touches down sound-flag synchronized action controller electrical switch poles 3P to connect an activated electric circuit C1A: "sound-flag synchronized action controller electrical switch" 3 is "ON" position 4, FIG. 4. When there is no sound impulse 1S there is not any electric current flows; sound flag synchronized action controller electrical switch electromagnet 3S does not active, therein switch flat spring 3F springs switchblade 3B back to make electrical conductive bridge 3R untouched sound-flag synchronized action controller electrical switch poles 3P: "sound-flag synchronized action controller electrical switch" 3 is turned "OFF" FIG. 3. The sequence "ON", "OFF" of "sound-flag synchronized action controller electrical switch" 3 is conducted by sound impulse 1S of voice, music, noise etc. to activate activated electric circuit C1A to effect on motive devices 2M.

Accordingly, the sound, the action flag 1F, the sound activated unit 1U, the "sound-flag synchronized action flagpole wind current controller" 2, the "sound-flag synchronized action controller electrical switch" 3, the motive devices 2M and the electric circuits C1A and C3S begin each cycle in sound-flag synchronized action.

It should be understood that the blower 1B, the sound activated unit 1U and the flagpole wind control bar hold-electromagnet 2H have different electric circuits from sound-flag synchronized action electric circuits C1A and C3S.

Activated electric circuit C1A can be single-pole or poles and electric input circuits are fixed with AC domestic electric load or DC battery load. Activated electric circuit C1A also can be a heavy-duty electric power load to operate several motive devices 2M such as motor, solenoid, air valve controller etc. in the movement not only of action-flag, but also of action-puppet, action-model and thing.

All devices of sound-flag synchronized action controller assembly SFC are predetermined in dimension, position, material and shape and electric power source VDC or VAC.

CONCLUSION

The invention provides sound or voice or dominant beat of music as impulse for a higher potential of flag movement. Sound-flag synchronized movement controller device creates action-flag actions such as waving, jumping and dancing. Sound-flag synchronized movement controller maneuvers the relation between sound and action-flag; in contrast to conventional flag, never responds to the sound.

It is a yet further object of the invention to provide suitableness for particular purpose of action-flag: displaying at a ceremony, a building and decoration place; and performing with dancing show, marching band etc.

It is another object that the present invention could offer a pleasant view and a higher potential movement not only of action flag, but also of action-puppet, action-model and action-thing.

To the accomplishment of the above and related objects the invention may be embodied in the form illustrated in the accompanying drawings. Attention is called to the fact, however, that the drawings are illustrative only. Variations are contemplated as being part of the invention.

What is claimed is:

1. A sound flag synchronized action controller assembly consists: flagpole, flagpole interior, blower, blower pipe, action flag, sound impulse, sound activated unit, sound flag synchronized action controller electrical switch, sound flag synchronized action controller electrical switch circuit, sound flag synchronized action flagpole wind current controller and activated electric circuit; said sound flag synchronized action flagpole wind current controller consists: a flagpole wind control plate, a rotation axis, a flagpole wind control bar, a flagpole wind control bar push electromagnet, a flagpole wind control bar pull electromagnet, a flagpole wind control bar hold electromagnet with hold electromagnet electric circuit; said flagpole wind control plate is in said flagpole interior and lies symmetrically on said rotation axis; the two ends of said rotation axis hang on said flagpole at flagpole diameter; said rotation axis connects at right angle with said flagpole wind control bar at one end to make the position of said flagpole wind control bar and said flagpole wind control plate takes the shape of a letter T; said flagpole wind control bar is made of magnetic metal and is located at vertical position; said flagpole wind control plate is in a horizontal position; said flagpole wind control bar movement makes said rotation axis and said flagpole wind control plate to move; opening of said flagpole wind control plate lets blower wind current to move into said flagpole interior toward and wave said action flag; said sound activated unit receives said sound impulse and activates sound flag synchronized action controller electrical switch electromagnet electric current flows to sound flag synchronized action controller electrical switch electromagnet to turn on said sound flag synchronized action controller electrical switch; said sound flag synchronized action controller electrical switch connects said activated electric circuit to activate said flagpole wind control bar pull and push electromagnets to be effected on said flagpole wind control bar; said flagpole wind control bar push electromagnet pushes said flagpole wind control bar to rotate upward; said" flagpole wind control bar pull electromagnet pulls said flagpole wind control bar to horizontal position to rotate said flagpole wind control plate vertical position to open said flagpole interior for said blower wind current blows said action flag; said flagpole wind control bar hold electromagnet holds said flagpole wind control bar as long as necessary; said flagpole wind control bar hold electromagnet and said flagpole wind control bar pull electromagnet are at a horizontal position and said flagpole wind control bar push electromagnet is at a vertical position; when there is no said sound impulse there is not any electric current flowing; therein said flagpole wind control bar push electromagnet and said flagpole wind control bar pull electromagnet do not act on said flagpole wind control bar; said flagpole wind control bar falls down by gravity, back to previous said vertical position to make said flagpole wind control plate back to said horizontal position; said flagpole wind control plate closes said flagpole interior when there is no blower wind current to blow said action flag; the sequence of opening and closing of flagpole wind control plate is controlled by a plurality of different sound impulse to create a plurality of different motions of action flag; accordingly, said sound flag synchronized action controller assembly begins each cycle of sound flag synchronized action.

2. The sound flag synchronized action controller electrical switch of claim 1, wherein said sound flag synchronized action controller electrical switch consists: switch base, switchblade, said sound flag synchronized action controller electrical switch electromagnet, sound flag synchronized action controller electrical switch electromagnet electric circuit, and sound flag synchronized action controller electrical switch poles; said switchblade includes three parts attach together: switch flat spring, non-electrical conductive handle and electrical conductive bridge; one end of said switch flat spring is mounted on said switch base, another end attaches with one end of non electrical conductive handle; said switch flat spring is made of magnetic metal and is separated with said electrical conductive bridge by said non electrical conductive handle in the middle; said sound flag synchronized action controller electrical switch electromagnet could be either pull electromagnet when location below said switchblade or push electromagnet when location above said switchblade; when said sound activated unit responds to said sound impulse, one said sound flag synchronized action controller electrical switch electromagnet electric current is created to flow in said switch electromagnet electric circuit to activate said sound flag synchronized action controller electrical switch electromagnet; said sound flag synchronized action controller electrical switch electromagnet pulls or pushes said switchblade down to make said conductive bridge contact said sound flag synchronized action controller electrical switch poles with said activated electric circuit when said sound flag synchronized action controller electrical switch is turned on; when there is no said sound impulse there is not any electric current flowing, said sound flag synchronized action controller electrical switch electromagnet does not activate; when said switch flat spring springs said switchblade back, said electrical conductive bridge disconnects sound flag synchronized action controller electrical switch poles; when said sound flag synchronized action controller electrical switch is turned off; the sequence of turning on and turning off of said sound flag synchronized action controller electrical switch is conducted by said sound impulse of voice, music, or noise to activate said activated electric circuit to control the movement not only of the flag, but also of a puppet or a model.

3. Said sound flag synchronized action controller assembly of claim 1 is predetermined in dimension, position, material, shape, electric power source; and can be maneuvered either by hand, by sound, by voice or by musical impulse.

* * * * *